United States Patent [19]

Stinson

[11] Patent Number: 5,009,009

[45] Date of Patent: Apr. 23, 1991

[54] SCRAPING TOOL

[76] Inventor: Robert A. Stinson, Box 107
Greenbriar Acres, Wise, Va. 24293

[21] Appl. No.: 381,802

[22] Filed: Jul. 19, 1989

[51] Int. Cl.[5] ..... B26B 3/00

[52] U.S. Cl. ..... 30/172; 15/236.01

[58] Field of Search ..... 30/123, 169, 172, 152, 30/160, 161, 335, 336; 15/236.01, 236.05, 236.06; 7/105, 118-120, 126, 151, 166; 81/3.09, 3.55

[56] References Cited

U.S. PATENT DOCUMENTS

| | | | |
|---|---|---|---|
| 4,202,093 | 5/1980 | Wallerstein . | |
| 4,302,877 | 12/1981 | Hart et al. | 30/161 |
| 4,558,517 | 12/1985 | Gringer . | |
| 4,574,417 | 3/1986 | Magnasco . | |
| 4,679,275 | 7/1987 | Shannon . | |
| 4,709,478 | 12/1987 | Cortelyon, Jr. . | |

*Primary Examiner*—Douglas D. Watts
*Attorney, Agent, or Firm*—Jerry T. Kearns

[57] ABSTRACT

A scraping tool has an elongated generally rectangular housing formed by two mating shell halves. The housing has first and second opposite open ends. A first scraping blade is configured for scaping wood and is mounted for selective extension and retraction through the first open housing end. A second scaping blade is configured as a thin razor blade for scaping glass and is mounted for selective extension and retraction through the second housing open end. First and second actuating buttons are mounted for longitudinal sliding movement on opposite side faces of the housing and include locking lugs for securing the first and second scraping blades in selected adjusted position. A paint can opening bar is pivotally mounted in an elongated recess formed in a side wall of the housing for movement between open and closed positions. The scaping tool provides a combined tool designed for use by painters while performing various scraping activities related to painting.

15 Claims, 3 Drawing Sheets

SCRAPING TOOL

BACKGROUND OF THE INVENTION

1. Field of the Invention

The present invention relates to scraping tools, and more particularly pertains to an improved combination scraping tool designed for use by painters which provides a variety of valuable painting related implements in a single housing. Conventionally, painters are required to carry a variety of separate scraping tools for scraping various surfaces such as wood and glass. Additionally, the painter must carry an implement to pry open paint can lids. These various implements are relatively bulky and cumbersome for a painter to carry. In order to overcome this problem, the present invention provides an improved combined scraping tool which combines wood and glass scrapers and a paint can opening tool in a single compact and easily portable housing.

2. Description of the Prior Art

Various types of scraping tools are known in the prior art. A typical example of such a scraping tool is to be found in U S. Pat. No. 4,202,093, which issued to M. Wallerstein on May 13, 1980. This patent discloses a low cost scraping implement having a wooden or plastic handle with a recess provided in one surface. A square of plate glass, metal or plastic is held in the recess by a wood retaining plate. A carriage bolt is received in aligned openings drilled through the handle member and the retaining plate. A wing nut threaded onto the shank of the carriage bolt draws the retaining plate toward the handle member to clamp the glass square in place. U.S. Pat. No. 4,558,517, which issued to D. Gringer on Dec. 17, 1985, discloses a hand scraper including upper and lower housing members defining a hollow casing and having an operating member axially movable therein to carry a blade between a first interior storage position, a second cutting edge protracted position, and a third blade removable and insertion position. U.S. Pat. No. 4,574,417, which issued to P. Magnasco on March 11, 1986, discloses a scraping tool having scraping blades mounted in fixed positions at opposite ends of an elongated handle. U.S. Pat. No. 4,679,275, which issued to T. Shannon on July 14, 1987, discloses a paint scraper having a pointed scraper head defined by angled edges of an elongated member which are chamfered at their point of intersection. The elongated member is rotatably received by a sheath which functions as a handle in operation, and a housing for storing the scraper head when not in operation. U.S. Pat. No. 4,709,478, which issued to D Cortelyou Jr. on Dec. 1, 1987, discloses a window paint scraper including an elongated handle bar having an enlarged head portion on which a glass scraping blade is mounted in a fixed orientation.

While the above mentioned devices are directed to scraping tools, none of these devices disclose a combination scraping tool having a wood scraper, a glass scraper and a paint can opening bar mounted for selective extension and retraction in a single compact and easily transportable housing. Inasmuch as the art is relatively crowded with respect to these various types of scraping tools, it can be appreciated that there is a continuing need for and interest in improvements to such scraping tools, and in this respect, the present invention addresses this need and interest.

SUMMARY OF THE INVENTION

In view of the foregoing disadvantages inherent in the known types of scraping tools now present in the prior art, the present invention provides an improved scraping tool. As such, the general purpose of the present invention, which will be described subsequently in greater detail, is to provide a new and improved scraping tool which has all the advantages of the prior art scraping tools and none of the disadvantages.

To attain this, a representative embodiment of the concepts of the present invention is illustrated in the drawings and makes use of a scraping tool having an elongated generally rectangular housing formed by two mating shell halves. The housing has first and second opposite open ends. A first scraping blade is configured for scraping wood and is mounted for selective extension and retraction through the first open housing end. A second scraping blade is configured as a thin razor blade for scraping glass and is mounted for selective extension and retraction through the second housing open end. First and second actuating buttons are mounted for longitudinal sliding movement on opposite side faces of the housing and include locking lugs for securing the first and second scraping blades in selected adjusted position. A paint can Opening bar is pivotally mounted in an elongated recess formed in a side wall of the housing for movement between open and closed positions. The scraping tool provides a combined tool designed for use by painters while performing various scraping activities related to painting.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved scraping tool which has all the advantages of the prior art scraping tools and none of the disadvantages.

It is another object of the present invention to provide a new and improved scraping tool which may be easily and efficiently manufactured and marketed.

It is a further object of the present invention to provide a new and improved scraping tool which is of a durable and reliable construction.

An even further object of the present invention is to provide a new and improved scraping tool which is susceptible of a low cost of manufacture with regard to both materials and labor, and which accordingly is then susceptible of low prices of sale to the consuming public, thereby making such scraping tools economically available to the buying public.

Still yet another object of the present invention is to provide a new and improved scraping tool which provides in the apparatuses and methods of the prior art some of the advantages thereof, while simultaneously overcoming some of the disadvantages normally associated therewith.

Still another object of the present invention is to provide a new and improved scraping tool which combines several frequently utilized painting accessory tools in a single, easily transportable housing.

Yet another object of the present invention is to provide a new and improved scraping tool for use by painters having a wood scraping blade and a glass scraping blade mounted for selective extension and retraction at opposite ends of a single compact easily transportable housing.

Even still another object of the present invention is to provide a new and improved scraping tool having a wood scraping blade, a glass scraping blade and a paint can opening bar mounted for selective extension and retraction in a single compact easily transportable housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
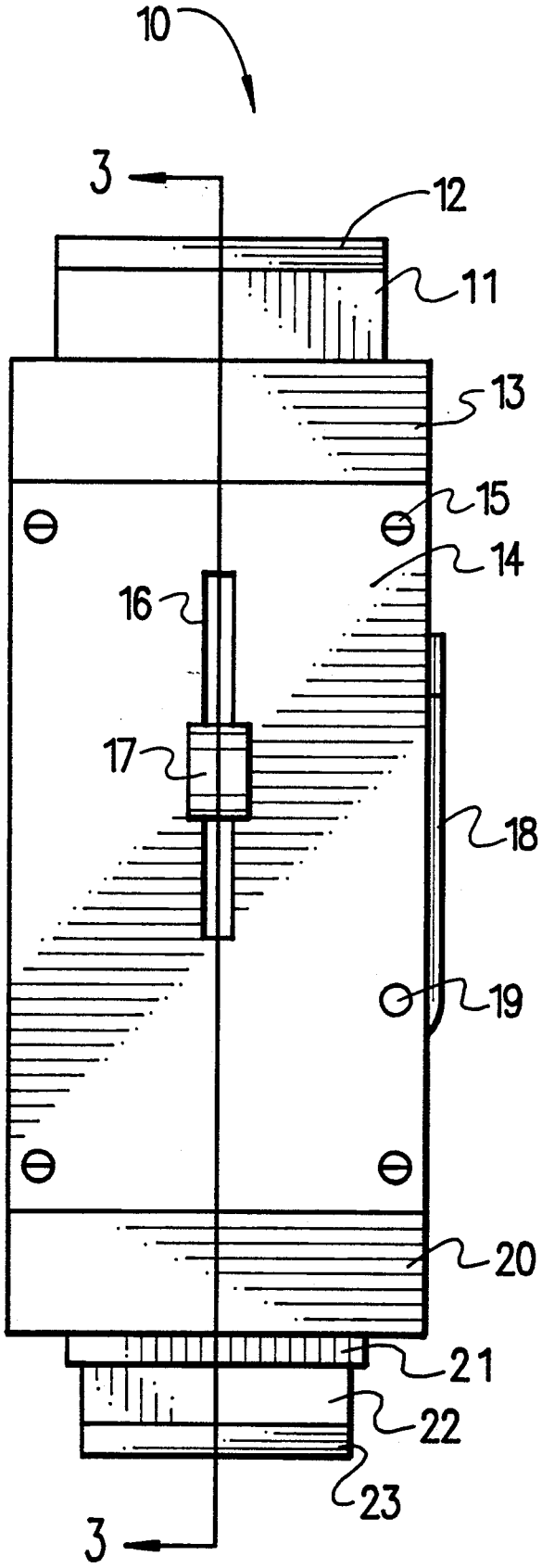
FIG. 1 is a front view of the scraping tool according to the present invention.

With reference now to the drawings, and in particular to FIG. 1 thereof, a new and improved scraping tool embodying the principles and concepts of the present invention and generally designated by the reference numeral 10 will be described.

More specifically, it will be noted that the first embodiment 10 of the invention includes an elongated, generally rectangular housing formed by two mating shell halves, a first of which is illustrated at 14. The mating shell halves are secured in an aligned orientation to form the housing by a plurality of screws 15. The housing has opposite open end portions 13 and 20 through which first 11 and a second 22 scraping blades are mounted for selective extension and retraction. The first scraping blade 11 is formed from a hardened steel material and has a sharpened edge 22 adapted for scraping paint from wooden surfaces. The shell half 14 has an elongated slot 16 in which an actuating button 17 is mounted for longitudinal reciprocal sliding movement. The actuating button 17 has a reduced diameter neck extending through the slot 16 and connected in a manner to be subsequently described and illustrated for reciprocating the first blade 11 between extended and retracted positions through the housing end 13. A paint can opening bar 18 is mounted in an elongated recess formed in a side wall of the housing by a pivot pin 19. The paint can opening bar 18 is adapted for pivotal movement to an open position for use in prying the lids off paint cans. A second retaining member 21 is mounted for movement through the open housing end portion 20 and serves to secure a second scraping blade 22. The scraping blade 22 is preferably of the thin razor blade type and has a sharpened edge 23 adapted for use in scraping paint off window pane surfaces.

Figure 2:
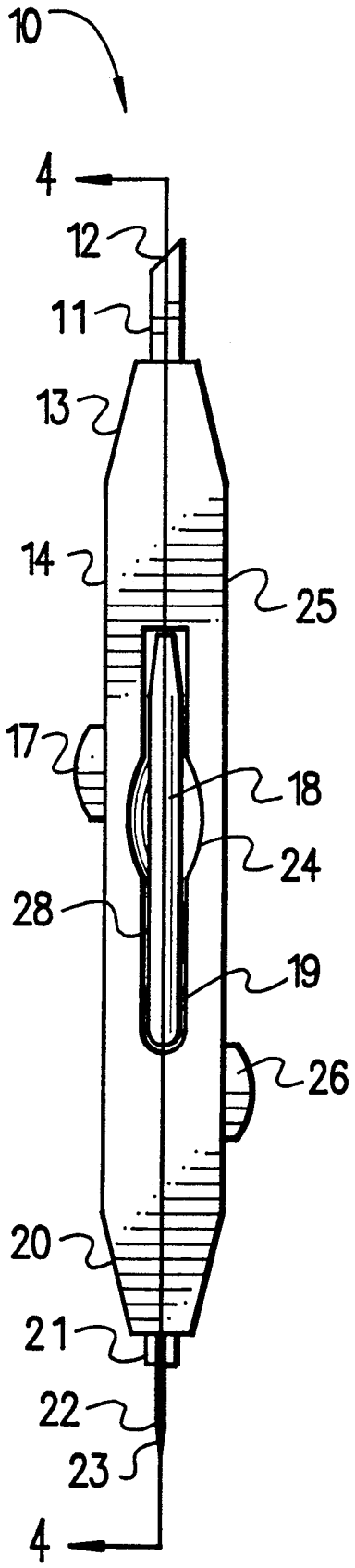
FIG. 2 is a side view of the scraping tool of FIG. 1.

As shown in the side view of FIG. 2, the housing is formed by mating shell halves 14 and 25. A second actuating button 26 is mounted for sliding movement through a slot formed in the shell half 25 and is connected to the second blade retaining member 21 for manually moving the scraping blade 22 between extended and retracted positions. The paint can opening bar 18 is mounted in an elongated recess 28 formed in a side wall portion of the housing. A pivot pin 19 extends through one end portion of the paint can opening bar 18, and an enlarged access portion 24 is formed in the recess 28 to facilitate manual pivotal opening of the bar 18.

Figure 3:
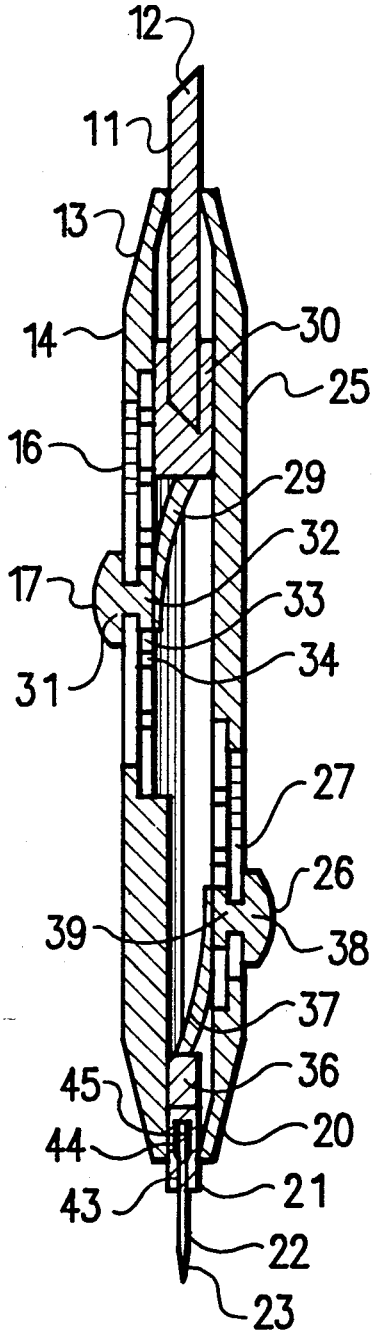
FIG. 3 is a cross, sectional view, taken along line 3—3 of FIG. 1.

As shown in the cross sectional view of FIG. 3, the first actuating button 17 has enlarged exterior 17 and interior 32 head portions which are connected by a reduced diameter neck 31 which extends through the slots 16. A locking groove is formed in an interior surface 33 of the shell half 14 and forms parallel side walls disposed on opposite sides of the slot 16. A plurality of arcuate recesses 34 are formed in aligned pairs in each of the side walls for cooperation with locking lugs provided on the interior head portion 32. These features will be better appreciated with reference to the following descriptions and illustrations. A first blade retaining member 30 is formed as a generally rectangular block and is provided with a transverse slot which receives an inner end of the first scraping blade 11. As illustrated, the blade 11 may have opposite sharpened ends so as to provide two reversible scraping edges. The retaining member 30 may be provided with one or more set screws for clamping engagement with the inner end of the blade 11 in the blade retaining member slot. The housing forms a hollow interior portion which defines a linear guide track for the movement of the blade retaining member 30 and for the movement of the second blade retaining member 21. A first leaf spring 29 is connected to an inner end of the first blade retaining member 30 and to the interior head 32 of the actuating button 17. The spring 29 biases the actuating button 17 to a locked position, with the locking lugs on the head 32 in engagement with a pair of aligned recesses 34. Additionally, the spring 29 provides an actuating connection between the button 17 and the retaining member 30 to allow selective extension and retraction of the blade 11 by manipulating the button 17. The linear guide track tapers to a reduced thickness portion adjacent the first open end 13 which allows passage of the blade 11, but restrains outward movement of the retaining member 30. A similar actuating mechanism is provided for selectively extending and retracting the blade 22. The second actuating button 26 extends through an elongated slot 27 formed through the shell half 25. The actuating button 26 has enlarged exterior 26 and interior 39 head portions connected by a reduced diameter neck 38. The retaining member 21 has an inner end portion 36 which is connected to a second leaf spring 37. An inner end of the second spring 37 is secured to the interior head 39 of the button 26. The second blade retaining member 21 includes a lateral slot having an enlarged thickness inner portion 44 and a reduced thickness outer portion 43. The blade 22 has an enlarged thickness inner portion 45 received in the enlarged thickness inner portion 44 of the slot in the retaining member 21. This allows lateral insertion of the blade 22, but restrains the blade 22 against relative longitudinal movement with respect to the retaining member 21. It should be noted that the retaining member 21 may be extended through the open end 20 to allow installation of a new blade without requiring disassembly of the housing.

Figure 4:
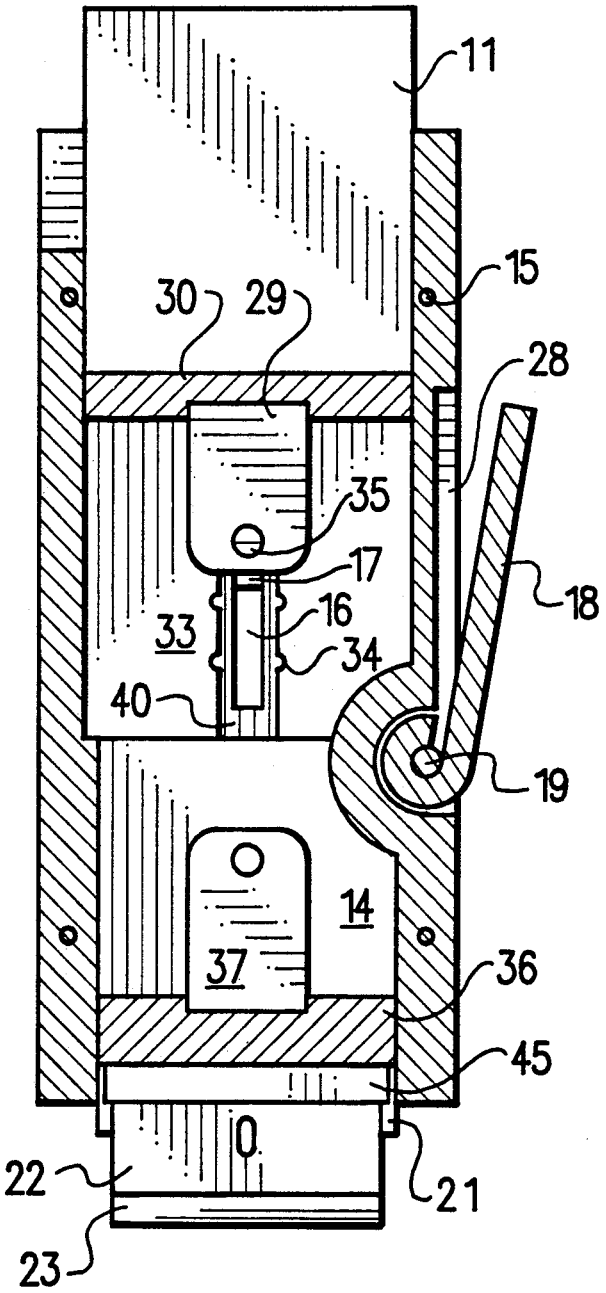
FIG. 4 is a cross sectional view, taken along line 4—4 of FIG. 2.

A shown in the cross sectional view of FIG. 4, the leaf spring 29 may be secured to the interior head portion of the actuating button 17 by a screw 35. The outer end of the spring 29 is secured to the blade retaining member 30, in a variety of conventional fashions, for example adhesively, by welding, or through the use of suitable threaded fasteners. The actuating button 17 is mounted for linear movement along the slot 16. The first locking groove 40 is formed in an inner surface 33 of the housing shell half 14 and provides opposite parallel side walls disposed on opposite sides of the slot 16. A plurality of arcuate recesses 34 are formed in aligned pairs and spaced along the groove 40 for engagement with locking lugs provided on the interior head portion 32 (FIG. 3) of the button 17.

Figure 5:
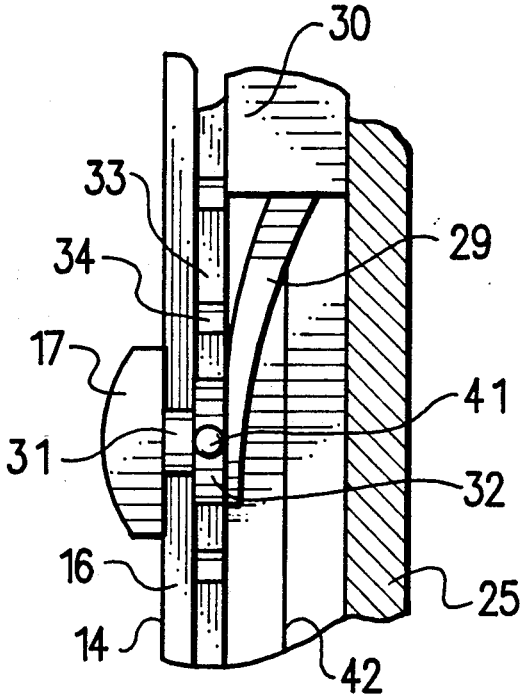
FIG. 5 is an enlarged cross sectional detail view, illustrating the construction of the blade locking mechanism.

As shown in FIG. 5, the locking lugs on the interior head portion 32 consists of hemispherical projections, one of which is illustrated at 41. The opposite locking lug is formed on the opposite side of the head 32. The lugs 41 are dimensioned for engagement with the recesses 34 formed in the side walls of the groove 40, as best seen in FIG. 4. In the illustrated position, the actuating button 17 is disposed in a locked position, with the laterally extending locking lugs, for example 41, disposed in engagement with a selected aligned pair of the recesses 34. The housing shell halves 14 and 25 meet at a line of intersection 42.

Figure 6:
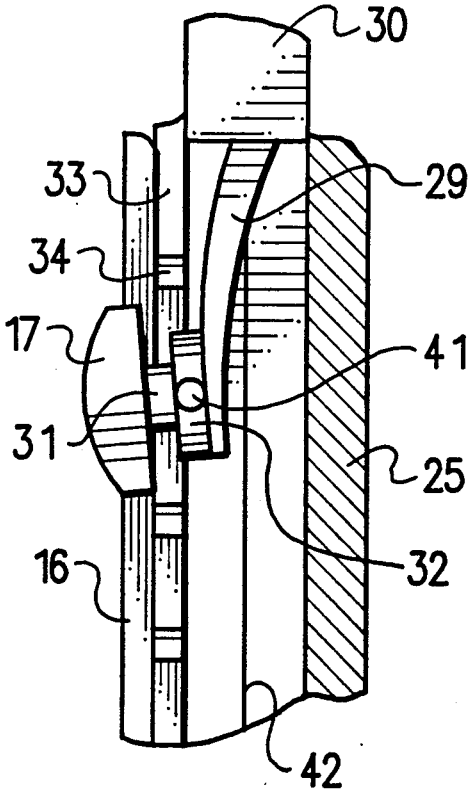
FIG. 6 is an enlarged cross sectional detail view illustrating the manner of operation of the blade extending and retracting mechanism.

FIG. 6 illustrates the manner of use of the blade extending and retracting mechanism. The push button 17 is depressed, and manually rocked as shown, against the bias of the leaf spring 29. This removes the locking lugs, for example 41, from engagement with the recesses 34, and allows the button 17 to be slid along the slot 16 to extend or retract the blade retaining member 30 and the attached scraping blade. It should be noted that the blade actuating and locking mechanism associated with the second scraping blade 22, (FIG. 3) is identically constructed.

As may now be understood, the present invention provides a combined paint scraping tool which includes a plurality of painting accessory implements in a single, inexpensive, compact and easily transportable housing. This alleviates the necessity for a painter to carry a number of separate expensive, bulky and inconvenient tools.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the U.S. is as follows:

1. A scraping tool, comprising:

a generally rectangular elongated housing having a hollow interior portion, first and second opposite side faces, and first and second opposite open ends;

a first scraping blade mounted in a first blade retaining member received for reciprocal linear movement within said housing hollow interior portion, said first blade mounted for selective extension and retraction through said first open end;

a first actuating button extending through a first elongated slot formed through said first side face;

first securing means connecting said first actuating button to said first blade retaining member;

first locking means for locking said first actuating button in a selected position;

a second scraping blade mounted in a second blade retaining member received for reciprocal linear movement within said housing hollow interior portion, said second blade mounted for selective extension and retraction through said second open end;

a second actuating button extending through a second elongated slot formed through said second side face;

second securing means connecting said second actuating button to said second blade retaining member; and second locking means for locking said second actuating button in a selected position.

2. The scraping tool of claim 1, further comprising an elongated recess formed in a side wall portion of said housing; and a paint can opening bar pivotally mounted for movement into and out of said recess.

3. The scraping tool of claim 1, wherein said first securing means comprises a leaf spring.

4. The scraping tool of claim 1, wherein said second securing means comprises a leaf spring.

5. The scraping tool of claim 1, wherein said first locking means comprises:

enlarged exterior and interior head portions on said first actuating button connected by a reduced diameter neck extending through said first slot;

a first locking groove formed on an interior surface of said housing, said first locking groove having opposite parallel side walls disposed on opposite sides of said first slot;

a plurality of pairs of aligned spaced recesses formed in said side walls of said first locking grooves; and a pair of locking lugs extending laterally from opposite sides of said interior head of said first actuating button, said locking lugs dimensioned for engagement with said recess.

6. The scraping tool of claim 1, wherein said second locking means comprises:

enlarged exterior and interior head portions on said second actuating button connected by a reduced diameter neck extending through said second slot;

a second locking groove formed on an interior surface of said housing, said second locking groove having opposite parallel side walls disposed on opposite sides of said second slot;

a plurality of pairs of aligned spaced recesses formed in said side walls of said second locking grooves; and a pair of locking lugs extending laterally from opposite sides of said interior head of said second actuating button, said locking lugs dimensioned for engagement with said recess.

7. The scraping tool of claim 1, wherein said hollow interior portion tapers in thickness adjacent said first open end to allow passage of said first blade and to limit outward movement of said first blade retaining member.

8. The scraping tool of claim 1, wherein said hollow interior portion tapers in thickness adjacent said second open end to allow passage of said second blade and to force said second blade retaining member into clamping engagement with said second blade.

9. The scraping tool of claim 1, wherein said second blade retaining member comprises:

a rectangular block received for sliding movement in said hollow interior portion;

a slot having an enlarged thickness inner portion and a reduced thickness outer portion formed in an outer end of said block; and said second blade having an enlarged thickness inner end and a reduced thickness outer end received in said second blade retaining member slot, whereby said second blade may be laterally inserted in said second blade retaining member and subsequently restrained against longitudinal movement relative thereto.

10. A scraping tool, comprising:

an elongated, generally rectangular housing formed by two mating shell halves;

a plurality of threaded fasteners removably securing said shell halves in alignment to form said housing;

said housing having a hollow interior portion defining a linear guide track;

said housing having first and second opposite open ends;

a first blade retaining member formed by a rectangular block received for sliding movement in said guide track;

said first blade retaining member having a slot receiving an end portion of a first scraping blade configured for scraping wood, said first scraping blade mounted for extension and retraction through said first open end;

said guide track tapering to a reduced thickness adjacent said first open end to allow passage of said first blade and to limit outward movement of said first blade retaining member;

a first spring steel leaf spring having an outer end secured to an inner end of said first blade retaining member;

a first elongated slot formed through a first of said shell halves;

a first actuating button extending through said first slot, said first actuating button having enlarged exterior and interior head portions connected by a reduced diameter neck extending through said first slot;

a first locking groove formed on a interior surface of said first shell half, said first locking groove having opposite parallel side walls disposed on opposite sides of said first slot;

a plurality of pairs of aligned spaced recesses formed in said side walls of said first locking grooves;

a pair of locking lugs extending laterally from opposite sides of said interior head of said first actuating button, said locking lugs dimensioned for engagement with said recesses;

said first leaf spring having an inner end secured to said interior head of said first actuating button and biasing said locking lugs into engagement with said recesses;

a second blade retaining member formed by a rectangular block received for sliding movement in said guide track;

said second blade retaining member having a slot having an enlarged thickness inner portion and a reduced thickness outer portion;

a second scraping blade having an enlarged thickness inner end and a reduced thickness outer end received in said second blade retaining member slot, said second scraping blade configured for scraping glass;

said guide track tapering to a reduced thickness adjacent said second open end to allow passage of said second blade and to force said second blade retaining member into clamping engagement with said second scraping blade;

a second spring steel leaf spring having an outer end secured to an inner end of said second blade retaining member;

a second elongated slot formed in a second of said shell halves;

a second actuating button extending through said second slot, said second actuating button having enlarged exterior and interior head portions connected by a reduced diameter neck extending through said second slot;

a second locking groove formed on a interior surface of said second shell half, said second locking groove having opposite parallel side walls disposed on opposite sides of said first slot;

a plurality of pairs of aligned spaced recesses formed in said side walls of said second locking grooves;

a pair of locking lugs extending laterally from opposite sides of said interior head of said second actuating button, said locking lugs dimensioned for engagement with said recesses;

said second leaf spring having an inner end secured to said interior head of said second actuating button and biasing said locking lugs into engagement with said recesses;

an elongated recess formed in a side wall of said housing;

a paint can opening bar pivotally mounted in said recess for movement between open and closed positions; and an enlarged access portion formed in said recess to facilitate opening of said paint can opening bar.

11. A scraping tool, comprising:

an elongated housing having first and second opposite ends;

a first scraping blade mounted for selective extension and retraction through said first housing end;

a second scraping blade mounted for selective extension and retraction through said second housing end;

locking means for securing said first and second blades in a selected adjusted position; and a paint can opening bar mounted for pivotal movement between open and closed positions in an elongated recess formed in a side wall portion of said housing.

12. The scraping tool of claim 11, wherein said housing has parallel opposite side faces and said locking means comprises first and second slidable actuating buttons extending through first and second slots formed in said opposite side faces.

13. The scraping tool of claim 11, further comprising a linear guide track formed in a hollow interior portion of said housing; and first and second blade retaining members, respectively mounting said first and second blades, received for reciprocal linear movement in said guide track.

14. The scraping tool of claim 13, wherein said first blade retaining member comprises a rectangular block having a slot receiving an end portion of said first blade.

15. The scraping tool of claim 13, wherein said second blade retaining member comprises a rectangular block having a slot with an enlarged thickness inner portion and a reduced thickness outer portion; and said second scraping blade having an enlarged thickness inner end and a reduced outer end received in said second blade retaining member slot.

* * * * *